United States Patent [19]

Naito

[11] 4,192,446

[45] Mar. 11, 1980

[54] PAPERBOARD LIQUID CONTAINER

[75] Inventor: Naoki Naito, Tokyo, Japan

[73] Assignee: Jujo Paper Co., Ltd., Tokyo, Japan

[21] Appl. No.: 949,093

[22] Filed: Oct. 6, 1978

[30] Foreign Application Priority Data

Oct. 18, 1977 [JP] Japan ..... 52-139702[U]

[51] Int. Cl.[2] ..... B65D 5/72

[52] U.S. Cl. ..... 229/37 R; 229/17 G

[58] Field of Search ..... 229/17 G, 37 R

[56] References Cited

U.S. PATENT DOCUMENTS

| | | | |
|---|---|---|---|
| 2,470,199 | 5/1949 | Vivian | 229/17 G |
| 3,118,586 | 1/1964 | Kelly | 229/17 G |
| 3,399,820 | 9/1968 | Foster et al. | 229/17 G X |
| 3,474,951 | 10/1969 | Egleston et al. | 229/17 G X |

*Primary Examiner*—Davis T. Moorhead

*Attorney, Agent, or Firm*—Stevens, Davis, Miller & Mosher

[57] ABSTRACT

A liquid container having a container proper, a lid portion and bottom portion made of paperboard. Small pieces which protrude outwardly are disposed at the outer edges of inner bottom sheets. When the inner bottom sheets are bent along V-shaped fold lines, opening parts of the paperboard material at the small piece parts are held between tip pieces of outer bottom sheets in such a manner that the bent parts of the small pieces lie at the center of the bottom portion of the container. The opening parts are not exposed to the interior of the container. Therefore, the fear of contact of the opening parts with the content is completely eliminated, and the container can be utilized for a long period of time.

2 Claims, 8 Drawing Figures

PAPERBOARD LIQUID CONTAINER

This invention relates to a liquid container which employs a paperboard as its base material. More particularly, it relates to a container made of a paperboard in which opening parts of the paperboard are not held in contact with the content and thus may be utilized for a long period of time.

In order to preserve a liquid such as soy, an edible oil, which readily penetrates paper board containers, the inner surface of the paperboard is processed with thermo-adhesive plastics so as to prevent the penetration of the content into the paperboard. Since, however, opening parts of the paperboard may have been exposed at the center of the folded bottom portion of the container, it is sometimes the case that the liquid content penetrates into the paper layer and the paper part swells to weaken the bonding or to pollute the content. Therefore, the inventors have previously proposed in Japanese Utility Model Registration No. 924416 (refer to the official gazette of Japanese Utility Model Application Publication No. 23891/1968) a liquid container wherein opposing inner bottom sheets are bent, outer bottom sheets are partially inserted in the bent parts of the inner bottom sheets, and opening parts of the paperboard material as slightly exposed at the center of the bottom portion are covered with a hydrophobic synthetic resin. With such a liquid container, however, the opening parts are not perfectly protected, and it is therefore inevitable that the liquid pentrate to the opening parts over an extended period of time. Apart from the foregoing described liquid container, there is a system wherein tip pieces disposed at the peripheral edge of the bottom portion are fully bonded by only the inner surfaces, thereby preventing the opening parts of the material from being exposed. This system, however, is disadvantageous in that the steps of bending and bonding are complicated and the container bottom portion becomes thick in one area because of the overlap of the paperboard, so the standing stability of the assembled and formed container is not satisfactory.

An object of this invention is to provide a liquid container in which opening parts of a paperboard material at the bottom of the container are not exposed at all.

Another object of this invention is to provide a liquid container which can completely prevent the swelling of the bottom portion of the container and contamination of the content (liquid) by preventing contact of the liquid content with the opening parts of the paperboard.

According to this invention, small pieces which protrude outwards are disposed at outer edges of inner bottom sheets. When the inner bottom sheets are bent along V-shaped fold lines, opening parts of a paperboard material at the small piece parts are held between tip pieces of outer bottom sheets in such a manner that the bent parts of the small pieces lie at the center of the bottom portion of the container. The opening parts therefore are not exposed to the interior of the container. Thus contact of the opening parts with the content is completely eliminated, and the container is suited to preserve the content over a long period of time. Moreover, only small pieces are required to form the outward protuberances at the central parts of the outer edges of the opposing inner bottom sheets and to have fold lines formed therein. Therefore, the forming operations of the paperboard material are not complicated, and the container can be readily fabricated by the use of conventional processes for forming prismatic containers. Since the small protuberant pieces formed on the inner bottom sheets overlap between the inner and outer bottom sheets at the container bottom portion, no uneven part appears on the outer surface, and the bottom portion of the container smooth and is stable in the standing posture.

The foregoing and other objects are effected by the invention as will be apparent from the following description taken in connection with the accompanying drawing in which.

Figure 1:
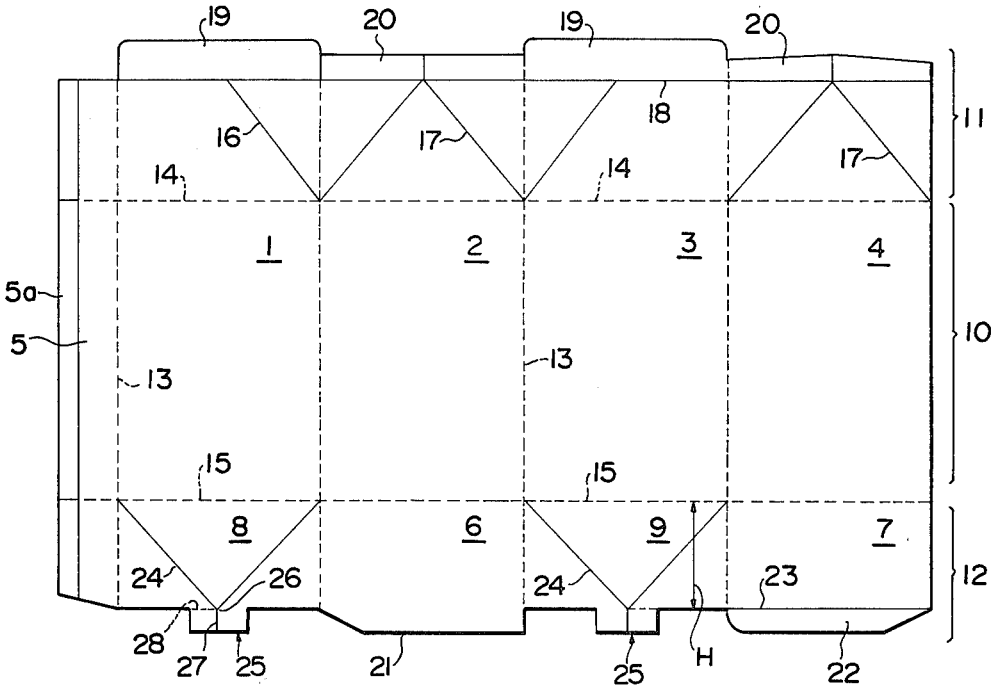
FIG. 1 illustrates a first embodiment of an expansion plan of a liquid container.

FIG. 1 is an expansion plan of a liquid container. The liquid container is so developed that its surface processed with thermo-adhesive plastics, e.g. polyethylene or the like hydrophobic plastics, for preventing the penetration of liquid and gases lies within. Solid lines within the lid contour indicate outer folds, while dotted lines indicate inner folds.

Four peripheral surface sheets 1, 2, 3 and 4 which define the body or proper 10 of the container are laterally arranged in a manner to be continuous through fold lines 13. Flaps 11 and 12 becoming a lid portion and a bottom portion are contiguous to the upper and lower edges of the peripheral surface sheets through fold lines 14 and 15, respectively. On the side of the peripheral surface sheet 1, there is an adjacent piece 5 which is joined with the adjoining peripheral surface sheet 4 when the container is assembled and formed.

The upper flap 11 is folded according to folds 16, 17 and 18, tip pieces 19 and 20 being joined with each other, whereby the lid in the shape of a roof is formed.

The lower flap 12 comprises first and second outer bottom sheets 6 and 7 opposing each other, and first and second inner bottom sheets 8 and 9 opposing each other and having a length H. A trapezoidal tip piece 21 having no fold is provided on the lower part of the first outer bottom sheet 6 by extending the sheet part as it is, while the second outer bottom sheet 7 is provided with a tip piece 22 through a fold line 23, this tip piece being substantially symmetrical to the tip piece 21. The first and second inner bottom sheets 8 and 9 are formed with V-shaped fold lines 24 so as to be folded into the shape of isosceles triangles whose bases are the fold lines 15 of the peripheral surface sheets and whose heights are the lengths of the sheets 8 and 9. In addition, small pieces 25 are provided by slightly extending central parts of the outer edges of the inner bottom sheets 8 and 9. Each small piece 25 has a fold line 27 which extends vertically from the apex 26 of the V-shaped fold line 27, and a fold line 28 which extends horizontally from the apex to one root part of the small piece.

In forming the prismatic container using paperboard material which is cut and formed with the various fold lines as shown in FIG. 1, an end piece 5*a* adjacent piece 5 is folded up into the outer fold and is bonded to the outer surface of the adjoining piece, and the adjacent piece 5 is folded down into the inner fold along the fold line 13 with the adjacent piece 5 including the folded-back surface of the end piece 5*a* thermally bonded to the inner edge of the peripheral surface sheet 4. Subsequently, the inner bottom sheets are folded in into the shape of the letter V according to the fold lines of the lower flap 12, and the outer bottom sheets are placed on the outer sides thereof and then bonded. Procedures for forming the lid with the upper flap 11 are the same as in the prior-art type container. Therefore, the detailed description and illustration are omitted, and the bottom portion will be explained below.

Figure 2:
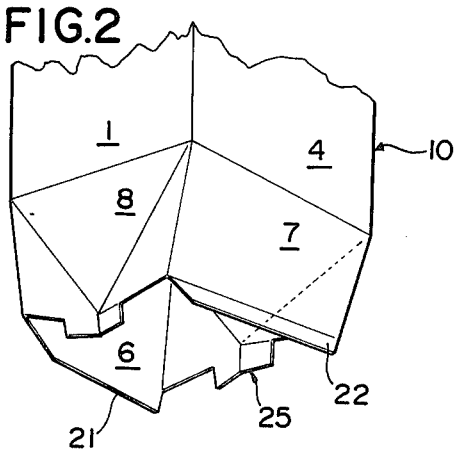
FIG. 2 is a perspective view of a bottom portion of the container in the course of assembling and forming the container.

FIG. 2 illustrates the course in which the bottom portion is being folded. Since the fold lines in FIG. 1 are depicted with the inner surface lying above, the folding-inwardly and the folding outwardly appear in the converse forms at the parts viewed from outside in FIG. 2.

Figure 3:
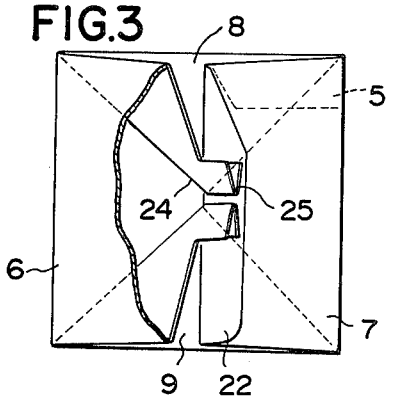
FIG. 3 is a bottom plan of the container with part of an outer bottom sheet broken away.

That is, the V-shaped fold lines 24 of the inner bottom sheets 8 and 9 are folded up as viewed from the inner surface of the container, but they are folded down as viewed from outside. As a result, the outer bottom sheets 6 and 7 are folded outside the inner bottom sheets 8 and 9. Since the inner bottom sheets are folded in into the form of the letter V, their parts in the shape of isosceles triangles are exposed inside the container and protrude towards the tips of the inner bottom sheets. In addition, as shown in FIG. 3, the parts of the small pieces 25 folded by the fold lines 27 and 28 are placed on a central part of the inner surface of the tip piece 22 of the second outer bottom sheet 7 bent outwards. Further, the tip piece 21 of the first outer bottom sheet 6 is placed over or outside the small pieces 25 and are bonded integrally therewith. Thus, the small pieces 25 are sandwiched in between the tip pieces 21. In FIG. 3, in order to clearly show the folded state of the small pieces 25, the tip part of the first outer bottom sheet 6 is broken away.

Figure 4:
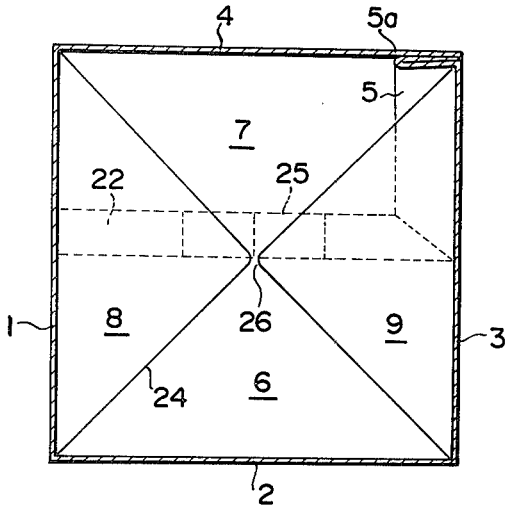
FIG. 4 is an enlarged cross-sectional view of the container bottom as taken along the middle thereof.

By folding and bonding the paperboard as in FIG. 3, as illustrated in FIG. 4 which is an enlarged cross section of the middle of the container, the inner bottom sheets 8 and 9 folded in into the shape of triangles are opposingly arranged in the innermost at the bottom portion of the container, the first and second outer bottom sheets 6 and 7 are exposed similarly in the shape of triangles in blank spaces, the small pieces 25 extending from the inner bottom sheets are folded and interposed between the tip pieces 21 and 22, and the apexes of the respective inner bottom sheets 8 and 9 are arranged substantially at the center of the inner surface of the bottom portion and in proximity to each other. Opening parts of the paperboard material exist at the extremities of the small pieces 25. Since the opening parts are held between the tip pieces 21 and 22 off the center of the bottom portion owing to the folding of the small pieces 25, they are not exposed to the interior of the container at all. Accordingly, when after thermally bonding the peripheral surface sheets and the bottom portion the content (liquid) is poured and the lid is thermally bonded, the penetration of the liquid into the paper does not occur and the container can be used for a long period of time.

FIGS. 5 to 8 illustrate a second embodiment which is so modified that a part of the tip piece of the second outer bottom sheet is inserted below the bent parts of the inner bottom sheets.

Figure 5:
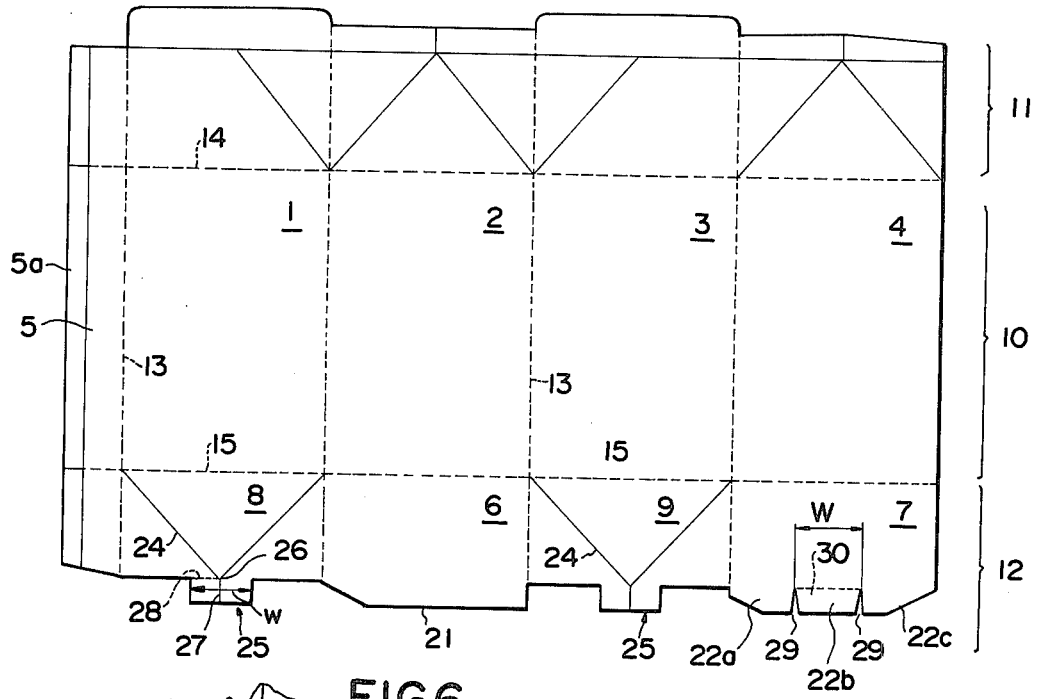
FIG. 5 illustrates a second embodiment of an expansion plan of a liquid container.

FIG. 5 is an expansion plan in which a paperboard is cut with its plastics-processed surface lying above as in FIG. 1. The paperboard is the same as in FIG. 1 except that the tip piece 22 of the second outer bottom sheet 7 is provided with notches 29 in the vertical direction at an interval W which is equal to or greater than the width w of the small piece 25 of the inner bottom sheet, to divide the piece 22 into three sections 22*a*, 22*b* and 22*c*, and that a fold line 30 is formed at the root of the central section 22*b* intervening between the notches.

Figure 6:
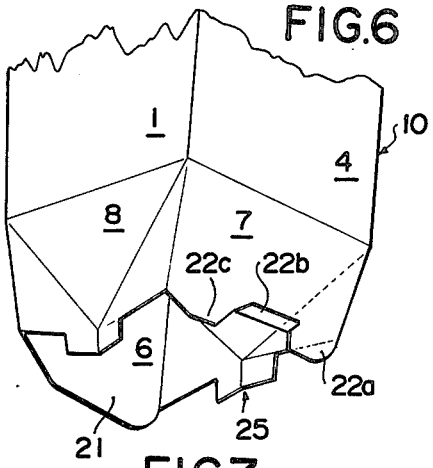
FIG. 6 is a perspective view of a bottom portion of the container in the course of assembling and forming the container.
Figure 7:
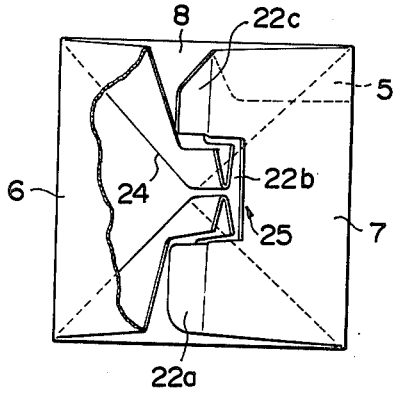
FIG. 7 is a bottom plan of the container with part of an outer bottom sheet broken away.
Figure 8:
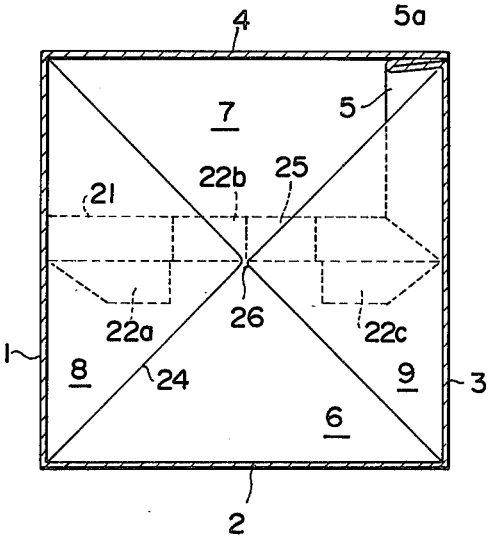
FIG. 8 is an enlarged cross-sectional view of the container bottom as taken along the middle thereof.

With the paperboard material cut and formed with fold lines as shown in FIG. 5, the peripheral surface sheet 4 and the adjacent piece 5 are bonded to form a prism and thereafter the inner bottom sheets 8 and 9 are folded in along the V-shaped fold lines 24 as in the case of FIG. 1. In the course of the folding, as shown in FIG. 6, triangular surfaces which appear owing to the V-shaped fold lines of the inner bottom sheets 8 and 9 are formed in a manner opposed to each other, the sections 22*a* and 22*c* of the tip piece of the second outer bottom sheet 7 are extended in a manner to be even with the outer bottom sheet 7, and only the central section 22*b* is bent. The small pieces 25 of the inner bottom sheets overlap outside the section 22*b*, and the tip piece 21 of the first outer bottom sheet 6 lies thereon and is joined therewith. The right and left sections 22*a* and 22*c* of the tip piece 22 extend on the same plane as that of the second outer bottom sheet 9. By folding them inwards still deeper in a state of FIG. 7, they are inserted between the triangular overlap parts of the inner bottom sheets, whereupon they are bonded. FIG. 8 is an enlarged section of the container as cut in the middle after the container has been formed. Also in case of this embodiment, as in the illustration of FIG. 4, the apexes 26 of the V-shaped fold lines in the inner bottom sheets are arranged in proximity to the center of the inner surface of the bottom portion. The opening parts of the paperboard are sandwiched in between the tip pieces 21 and 22 at the lower parts of the outer bottom sheets, so that they are not exposed inside the bottom portion of the container at all and the penetration of liquid is prevented.

What I claim is:

1. A liquid impermeable prismatically shaped paperboard comprising four peripheral surface sheets and an adjacent piece which are disposed in a manner to be continuous in a lateral direction through fold lines;

flaps forming a lid portion and a bottom portion respectively disposed in a manner to be contiguous to upper and lower edges of said peripheral surface sheets through fold lines;

said lid flap having oblique fold lines therein, and tip pieces for joining extending from an outermost end thereof, said tip pieces being folded along fold lines extending therebetween thereby forming the lid portion in the shape of a roof;

said bottom portion including outer bottom sheets and inner bottom sheets respectively opposing each other, tip pieces disposed at tips of the opposing bottom sheets of said container bottom portion, the opposing inner bottom sheets being formed with folds in the shape of isosceles triangles whose bases are the fold lines thereof, small pieces protruding outwardly beyond outer edges of said inner bottom sheets from central parts at which exist apexes of the isosceles-triangular folds; and said opposing inner bottom sheets being foldable inwardly, said small pieces being insertable between the two outer bottom sheets, said tip pieces of said opposing outer bottom sheets being placeable thereon, opening parts of said paperboard thereby being joinable in a manner not exposed to the interior of said container.

2. The container of claim 1, wherein the tip piece of one of said outer bottom sheets is provided with notches at an interval which is substantially equal to a width of the small piece of the inner bottom sheet, and only a section defined by said notches is formed with a fold line.

* * * * *